United States Patent [19]

Kränzle et al.

[11] 4,435,127

[45] Mar. 6, 1984

[54] APPARATUS WITH LATCHING EFFECT FOR LIMITING PRESSURE IN LIQUID FEEDING SYSTEMS

[76] Inventors: Josef Kränzle, Auerstrasse 42, 7918 Illertissen; Lutz Droitsch, Bussardweg 25, 4800 Bielefeld, both of Fed. Rep. of Germany

[21] Appl. No.: 292,125

[22] Filed: Aug. 12, 1981

[30] Foreign Application Priority Data

Oct. 2, 1980 [DE] Fed. Rep. of Germany ..... 3037259

[51] Int. Cl.[3] ..... F04B 49/08

[52] U.S. Cl. ..... 417/26; 417/307; 417/316

[58] Field of Search ..... 417/26–29, 417/38, 316, 317, 307, 308, 310, 311, 25, 18; 431/28, 38

[56] References Cited

U.S. PATENT DOCUMENTS 3,014,687 12/1961 Keisling et al. ..... 417/28 X
3,119,551 1/1964 Beeman ..... 417/28 X
3,446,238 5/1969 Norstrud et al. ..... 417/28 X
3,827,827 8/1974 Hill ..... 417/28
4,124,332 11/1978 Nishijyo ..... 417/38 X

*Primary Examiner*—Edward K. Look
*Attorney, Agent, or Firm*—Cushman, Darby & Cushman

[57] ABSTRACT

An apparatus having latching effect for limiting pressure in liquid feeding systems has a valve means inserted in the feeding path of a pump supplied liquid. The valve means includes a shunt valve opened upon excessive output pressure; the shunt output of the shunt valve is connected to a feed-back tube. There is further provided a back-stroke valve in the main feeding path of the liquid. A first pressure switch has the output pressure applied thereto while to a second pressure switch the input pressure at the shunt valve is applied. The two pressure switches are inserted into the switch-on circuit of the pump in such a manner that the pump is switched-on in the presence of a low output pressure and switched-off in the presence of an excessive output pressure.

9 Claims, 8 Drawing Figures

APPARATUS WITH LATCHING EFFECT FOR LIMITING PRESSURE IN LIQUID FEEDING SYSTEMS

Figure 1:
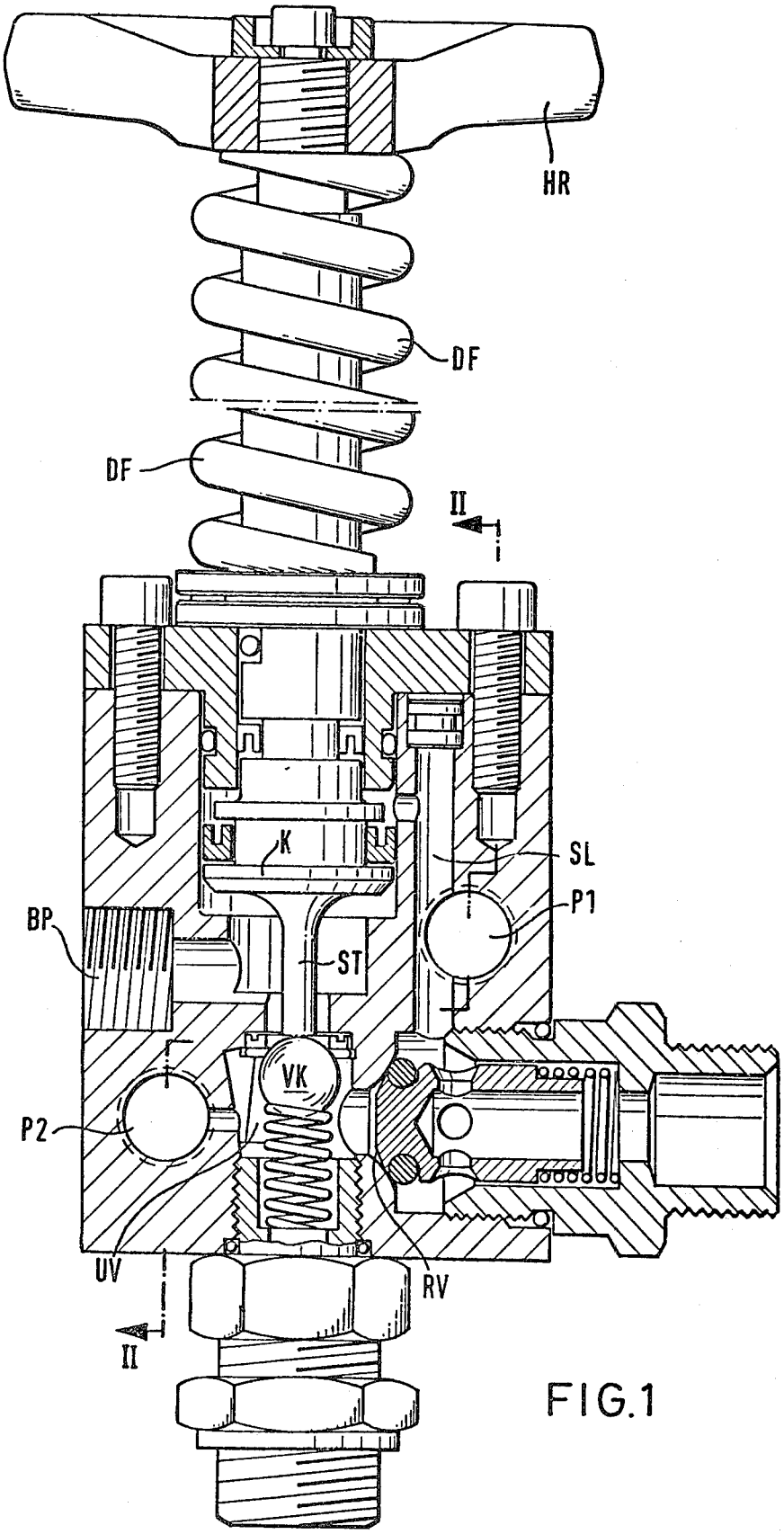

The invention relates to an apparatus with latching effect for limiting pressure in liquid feeding systems in particular high pressure washing systems where liquid is fed by a pump to a closeable delivery or output station a valve means being interposed into the feeding path including a shunting or bypass valve portion being opened under control of an excess output pressure the shunting valve output being connected to a feed-back tube and to a back-stroke or back pressure valve, e.g., a check valve being arranged in the main feeding path of the liquid.

With liquid feeding systems as high pressure washing systems, hydraulic controls or the like there is the problem that upon a sudden interruption of the feeding, for instance, due to the closing of a valve or a switch, there will be a stroke in view of the fast raise of the pressure which, on the one hand, produces a disturbing noise and, on the other hand, damages the elements of the system over a longer period. Therefore, there must be provided a storage tank, for instance, in the form of a hydro or gas storage device in order to dampen the pressure peaks.

In order to prevent such a stroke it has become known to interpose in the feeding part of the liquid a shunting or detour valve arranged to be opened when an excessive output pressure arises and which detours the liquid into a feedback tube connected to a supply tank supplying the liquid to the pump. The disadvantage of this apparatus consists in the fact that the pump is continuously feeding liquid through the feed-back path which gives rise only only to an excessive wear of the pump and to an undue power consumption but also to a further energy loss in the case that a circulating liquid is maintained at a high temperature.

It is an object of the present invention to improve an apparatus with latching effect for limiting pressure in a manner that, on the one hand, the damaging pressure stroke is avoided but that, on the other hand, the pump is switched on and off, respectively, according to the need of liquid at the delivery station.

According to the invention this object is achieved with an apparatus as specified above by the provision of a first pressure switch controlled by the output pressure and a second pressure switch controlled by the input pressure at the shunting valve and by the fact that the two pressure switches are included in the switching-on circuit of the pump such that with a low output pressure the pump is switched on and with an excessive output pressure it is switched off.

Further features and advantages of the apparatus according to the invention may be gathered from the subclaims and the description give below under reference to the drawings, which show FIG. 1 a sectional view of the apparatus for pressure limiting according to the invention, FIG. 2 a schematic presentation of the apparatus according to FIG. 1 viewed at an angle displaced by 90° in respect to the view of FIG. 1 for illustrating the connections of the two pressure switches and FIG. 3*a* to 3*e* various switching positions according to the possible states of the apparatus according to the invention.

The embodiment of the apparatus according to invention explained hereinafter relates to a pressure monitoring apparatus which in particular may be used in connection with high pressure washing systems where as a pressure switch electrical switches are provided.

Further possible applications of the apparatus according to the invention are in connection with hydraulic controls and liquid transmissions or the like.

The pump used in connection with the embodiment is driven by an electrical motor and the pressure switches act on electrical basis. However, electromagnetic, capacitive or optoelectronic switches could be used as well. For hydraulic drives hydraulic switches would be applicable. The pressure springs used with the switches are exchangeable which permits to change the actuating pressure in accordance with the hardness of the spring.

Generally speaking a pump driven by an electromotor supplies liquid from a storage tank via a feeding path to a delivery station being provided with a closing capability for instance a washing pistol. Within the feeding path there is a shunting or bypass valve UV and in series thereto a back-stroke or check valve RV. With the shunting valve being opened the liquid flows into the feed back tube or bypass BP back to the storage tank. Behind the back stroke valve RV there is provided a control conduit SL which directs the output pressure, which occurs at the input (inner) end of check valve RV, to a piston K being secured to the rod ST for the valve element VK. An excessive pressure threshold for the shunt valve UV is adjustable via the handwheel HR and by changing the pressure spring DF.

A first pressure switch P1 is connected to the control conduit SL and is controlled by the output pressure. A second pressure switch P2 is under the pressure existing in the valve chamber of the shunt valve UV.

Figure 2:
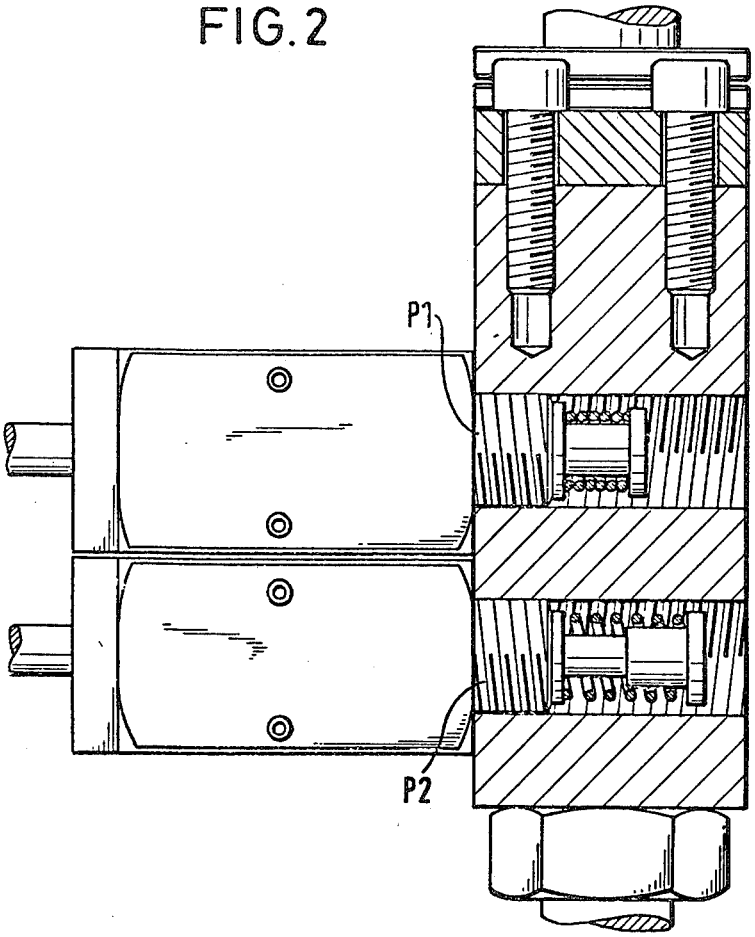

Though the above mentioned units may be individual separate units according to the invention they are included in a single valve body as shown in FIGS. 1 and 2.

The pressure switches P1 and P2 may be screwed in via thread holes in the valve body. Alternatively they may be secured and hammered or cast cylinders at or in the valve body. Preferably the threaded holes fully extend through the valve body such that at the rearside a pressure measuring means may be applied. Also the pressure existing there could be used for different control purposes. Otherwise the holes may be closed by a plug.

FIG. 2 shows which positions the pressure switches P1 and P2 may have. The pressure switch P1 is shown in its pressure applied position whilst the pressure switch P2 is in such a position in which a low pressure is applied to it.

FIGS. 3*a* to 3*e* show five different states of the apparatus according to the invention in relation to its electrical circuit.

The switch-on circuit for the electrical motor is connected to a power source and comprises the serial connection of a main switch HS, the switch P2 (low pressure), the switch P1 (low pressure) and the pump switching magnet or pump operating solenoid PS for switching on the motor. The contacts C of the high pressure positions of the pressure switches are connected to one terminal of the power source via a magnetic valve MV. The magnetic valve serves for switching on of an oil burner for heating the liquid.

In many instances, it is desired that the washing water be hot. Not only vehicle washing systems but other systems quite often use hot water. Consequently, it is necessary to heat the water which necessitates a heating device. Oil heating is commonly used to heat the water, as is electric heating, in lieu of coal, wood or gas. When no water is drawn, heating must be stopped, and vice-versa, since only the water flowing to the open outlet should be heated. The oil burner is controlled as it has been for decades by opening and closing a magnetic valve, sometimes referred to as a solenoid valve, which permits oil to flow to the spring nozzle.

Referring to FIGS. 3*a* to 3*e* the operation of the pressure monitoring device according to the invention will be explained in detail.

Figures 3A, 3B, 3C, 3D, 3E:
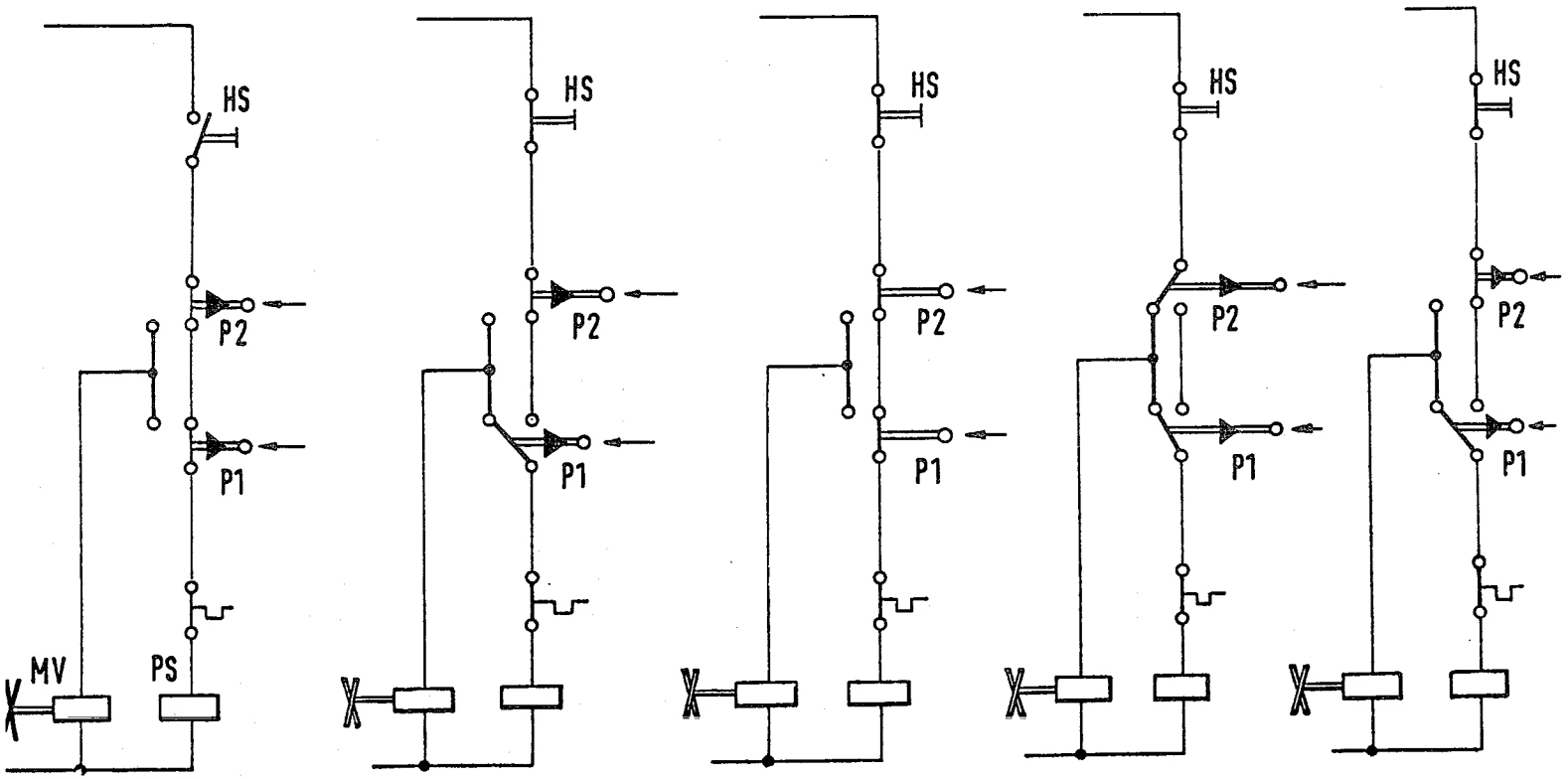
Figure 4:
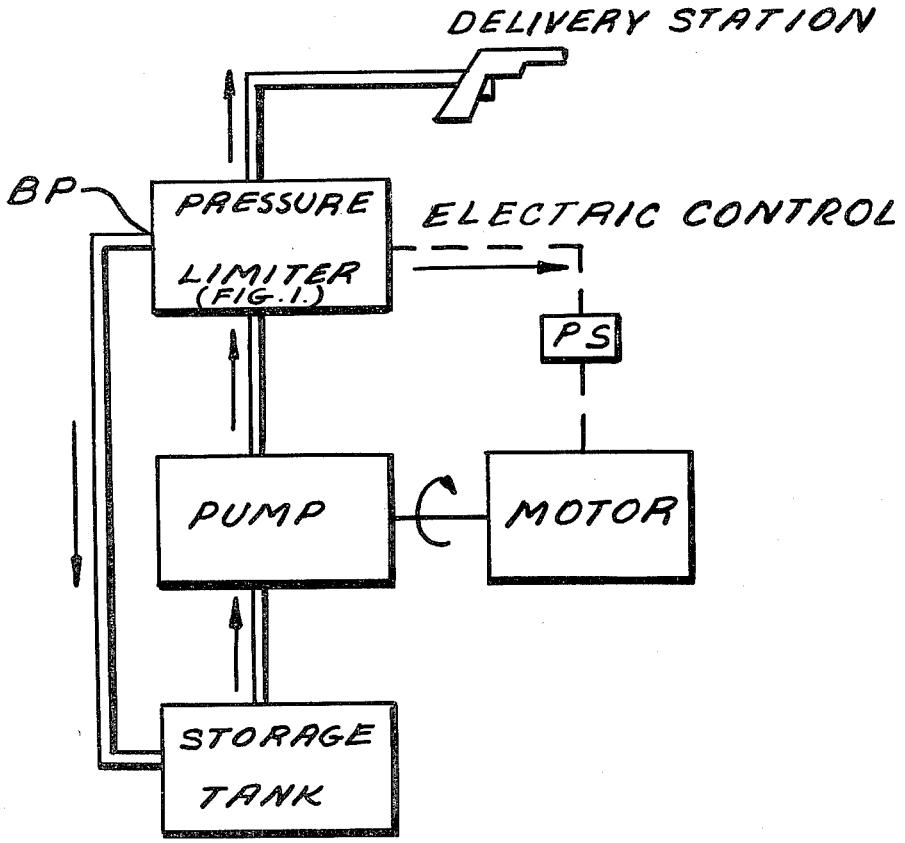

FIG. 3*a* shows the system in a switched-off condition. The main switch HS is opened whilst the pressure switches P1 and P2 are in the switched through condition (A–B) since no or a low pressure is applied to them. There is no current flow; thus the pump switching magnet PS and the magnetic valve MV are not energized. Upon closing of the main switch HS a current flows through the pump electromagnet PS and the pump is switched on. This results in the building up of a pressure at the output station which at a predetermined value changes the pressure switch P1 to its position AC (FIG. 3*b*), effecting the interruption of the current path and the switching off of the pump motor. The magnetic valve remains without current. The system is now ready for operation. When opening the washing pistol at the delivery station the pressure evades from the hose; the switch P1 has again applied a low pressure only resulting in the change into its position AB which leads to the energisation of the pump magnet PS (FIG. 3*c*). In the further cause of operation pressure is building up in view of the feeding of liquid by the pump. At a predetermined value the two pressure switches P1 and P2 switches to their positions AC (FIG. 3*d*). This is the position for continual operation in which in turn the magnetic valve is energized and fires the oil burner. The pump is still operating.

With the closing of the pistol a sudden excessive pressure is created at the delivery station such that via the control conduit SL the piston K is pressed against the ball VK resulting in the opening of the shunt valve UV. Thus, at first the medium creating the pressure peaks are shunted from the shunt valve chamber UK around the opened ball VK to the feed back tube BP. This causes a pressure break down in the shunt valve chamber UK effecting the switching off of the electro switch P2 resulting in the switching off of the magnets MV and PS associated to the oil burner and the pump motor. This means that the valve switches at first mechanically and that only after the removal of the pressure peak the motor is switched off such that no tension is imposed to the drive belt of the pump and no blocking pressure acts upon the actuating valves of the pump (FIG. 3*e*). Thus the condition according to FIG. 3*b* is achieved again which may be followed by a condition according to FIG. 3*c*.

By the hand wheel HR the bias for the valve body VK can be adjusted such that with the use of two pistols the switching off one pistol causes a minor opening of the shunt valve UV only which does not result in a switching off of the pump.

We claim:

1. A valve system for use in a liquid feeding system in which in operation liquid is fed by an electric pump to a delivery means, said valve system comprising:

a main outlet, a check valve, and an inlet connectable via a said valve to said main outlet, a bypass valve and a bypass outlet connectable to said inlet via said bypass valve which opens in response to a sudden increase in pressure at said main outlet, a first pressure switch in communication with said main outlet and settable to either a first condition or to a second condition when the pressure applied to said first pressure switch is less than or exceeds a predetermined threshold value respectively, a second pressure switch in communication with said inlet and settable to either a first condition or to a second condition when the pressure applied to said second switch is less than or exceeds a predetermined threshold value respectively, said first and second pressure switches being connected together in such a manner than when the pressure switches are both in said first condition or are both in said second condition a switch on path for said pump is closed enabling operation of the pump, the arrangement further being such that when said bypass valve is opened by said sudden pressure increase said second pressure switch is switched from its second condition to its first condition for switching off said pump by opening the associated switch on path.

2. Apparatus according to claim 1, wherein the two pressure switches are in such a serial connection in the pump switch-on path that the latter is closed whenever the two pressure switches are both in an on-position or an off-position.

3. Apparatus according to claim 1 or 2, wherein the bypass valve and the check valve are arranged in a common valve chamber also incorporating the two pressure switches.

4. Apparatus according to claim 3 wherein the first pressure switch is connected to a liquid control path which begins at the output side behind the check valve and which leads to an opening control means for the bypass valve.

5. Apparatus according to claim 4, characterized in that the opening control means for the bypass valve is adjustably biased.

6. Apparatus according to claim 3 wherein the second pressure switch is connected to a valve chamber of the shunt valve.

7. Apparatus according to claim 1 or 2 wherein the second pressure switch is arranged to close in its pressure applied condition an energizing circuit for a heating source.

8. Apparatus according to claim 1 or 2, characterized that the pressure switches are screwed into threaded holes provided in the valve body.

9. Apparatus according to claim 1 or 2 wherein the pressure switches are secured to means being formed at the valve body.

* * * * *